US006394442B1

(12) United States Patent
Antinora et al.

(10) Patent No.: US 6,394,442 B1
(45) Date of Patent: May 28, 2002

(54) KICKER WITH ADJUSTABLE CONTACT POINTS, FOR A SHEET OUTPUT APPARATUS IN A PRINTER OR COPIER

(75) Inventors: Terrance J. Antinora; Bruce J. DiRenzo, both of Rochester; Bryan C. Winkelman, Webster; Richard P. Ficarra, Macedon, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/661,607

(22) Filed: Sep. 14, 2000

(51) Int. Cl.[7] ..... B42C 1/12

(52) U.S. Cl. ..... 270/58.11; 270/58.08; 271/84; 399/405; 399/410

(58) Field of Search ..... 198/468.3, 456; 271/84, 267, 269; 270/58.01, 58.11, 58.08, 58.12, 58.13, 58.14, 58.16, 58.17; 399/410, 403, 405; 414/790.3

(56) References Cited

U.S. PATENT DOCUMENTS

| | | | | | |
|---|---|---|---|---|---|
| 5,104,282 | A | * | 4/1992 | Gleason | 271/186 |
| 5,141,218 | A | * | 8/1992 | Umetani | 271/104 |
| 5,201,517 | A | * | 4/1993 | Stemmle | 270/58.07 |
| 5,409,201 | A | * | 4/1995 | Kramer | 270/58.13 |
| 5,409,202 | A | * | 4/1995 | Naramore et al. | 270/58.08 |
| 5,642,876 | A | * | 7/1997 | Ferrara et al. | 270/58.01 |
| 5,918,871 | A | * | 7/1999 | Saito et al. | 270/58.11 |
| 6,283,354 | B1 | * | 9/2001 | Hirota et al. | 270/58.12 |
| 6,328,299 | B1 | * | 12/2001 | Coombs | 270/58.08 |

* cited by examiner

*Primary Examiner*—Christopher P. Ellis
*Assistant Examiner*—Patrick Mackey
(74) *Attorney, Agent, or Firm*—R. Hutter

(57) ABSTRACT

An output device for a copier or printer includes a stapler which is capable of placing a single corner staple in a set of sheets, or alternately two evenly-spaced staples along the edge of the set. A kicker member, which is shaped to push a stapled set toward an output tray, includes a contact point which is movable, such as by a spring mechanism, relative to the rest of the kicker member, so that the kicker member can accommodate a moving stapler head within the output device.

6 Claims, 2 Drawing Sheets

KICKER WITH ADJUSTABLE CONTACT POINTS, FOR A SHEET OUTPUT APPARATUS IN A PRINTER OR COPIER

FIELD OF THE INVENTION

The present invention relates to devices for collating, stacking, and stapling sheets output from office equipment, such as copiers or printers.

BACKGROUND OF THE INVENTION

With office equipment such as copiers and printers, it is common to provide "output devices," that is, devices which stack, collate, or staple output sheets into organized sets. A common feature of such output devices is a device known as a "disk stacker," in which there is provided a rotatable disk having a prong extending from the edge thereof. Sheets that are output from the printer or copier are placed in the throat between the prong and the rest of the desk, and the disk is rotated, carrying the sheet toward a stack of previous prints. In this way, the disk stacker can both collate and invert sheets which are output from the printer or copier.

A desirable feature of printers and copiers is the ability to staple sets of sheets which are output. Typically, immediately after a set of sheets is accumulated by, for instance, the disk stacker, the set is placed in proximity to a stapler head, which places a staple through the set. More advanced output devices are capable of placing staples in multiple positions along the edge of a set, so that, for example, a single output device can place a single staple in the corner of a set, or alternately placing two staples along one edge of the set, to yield a booklet-like output.

A common design challenge for output devices is to coordinate the placement and functions of a disk stacker and a stapling device within the same output device. In particular, in an advanced device, which is capable of placing single staples or double staples in a set, it may be necessary to move the stapler heads to the desired positions so that the staple is placed in the desired position on the set. This necessity to move the staple head may interfere with the architecture and function of other aspects of the output device, such as the disk stacker. Further, with a movable stapler head within the output device, the needed to accommodate other features of the output device may result in design compromises which can result in, for example, the sets being improperly skewed as they enter the output tray.

The present invention is directed toward a design of an output device, which is capable of placing a single corner staple or dual staples in a set, which overcomes some particular design difficulties.

DESCRIPTION OF THE PRIOR ART

U.S. Pat. No. 5,842,624 discloses a typical design of a stapler unit in an output device, in which the stapler head can move relative to the set, thereby placing the staple in the set at one or more selected locations.

U.S. Pat No. 5,188,353 discloses a typical design of a disk stacker, in particular one that includes a tamping mechanism which enables the disk stacker to provide small offsets of alternating sets output by the device.

SUMMARY OF THE INVENTION

According to the present invention, there is provided an apparatus for retaining a plurality of sheets in a position for stapling and for transferring a stapled set of sheets to an output location. A kicker contacts the set of sheets at an edge thereof. The kicker defines a first contact point and a second contact point, the second contact point being movable relative to the first contact point along the edge of the set of sheets. The kicker is urged against the set of sheets, thereby causing the kicker to push the set of sheets toward the output location.

DETAILED DESCRIPTION OF THE INVENTION

Figure 1:
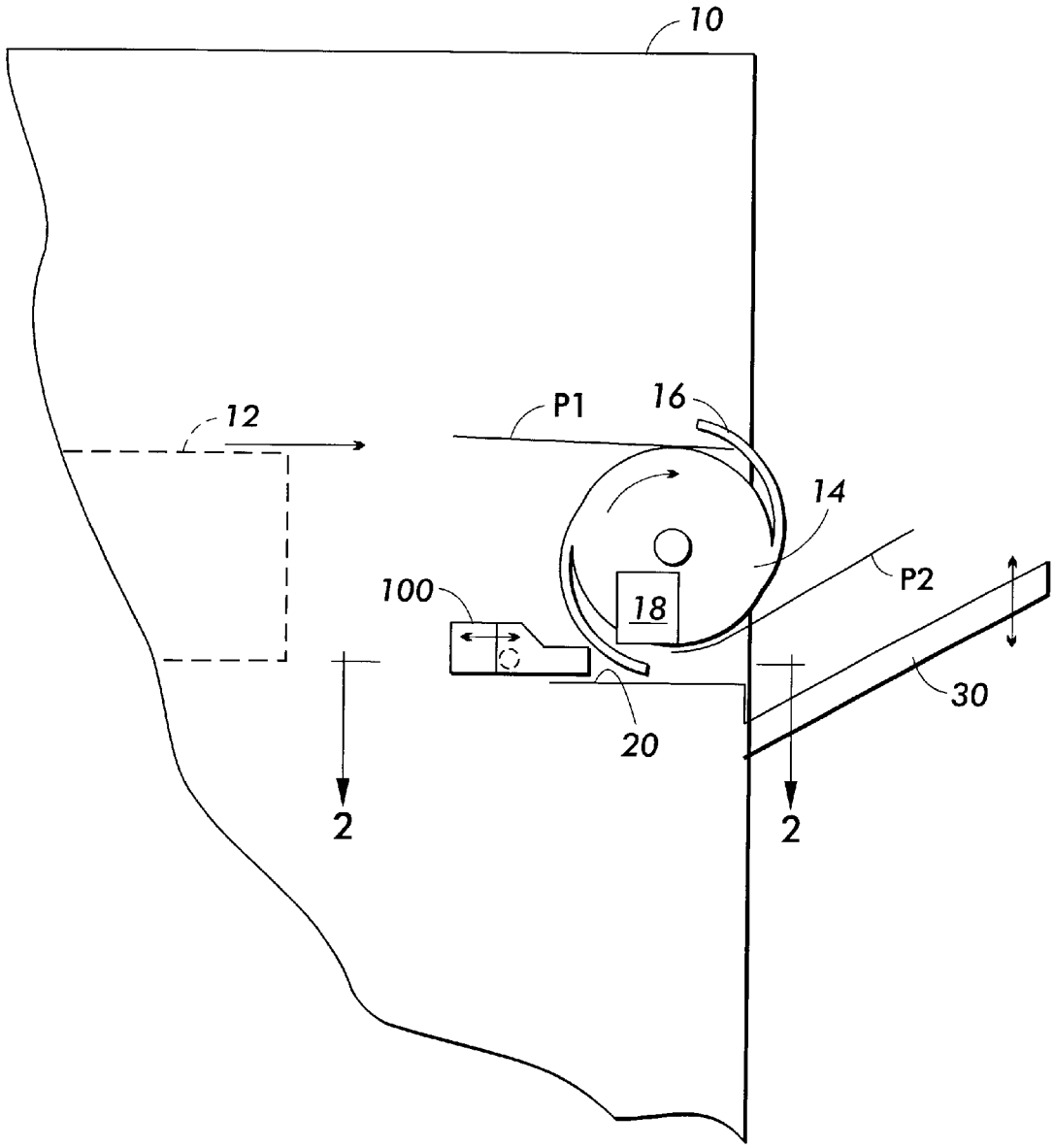
FIG. 1 is an elevational view showing some essential portions of an output device, such as including a disk stacker and a stapling apparatus, incorporating the present invention.

FIG. 1 is a partial elevational view of a copier or printer, generally indicated as 10, having an output device according to the present invention. The printer or copier 10 includes a marking device, generally indicated as 12, which, as is generally known, typically includes either a xerographic printing device or an ink jet printing device. The marking device 12 outputs a series of sheets having images thereon, which are desired to be collated, stacked, and stapled.

In the particular illustrated embodiment, there is provided a disk stacker and stapling apparatus. As is known the art, the main part of a disk stacker is one or more disks, shown generally as 14 in the Figure. Disk stacker 14 includes, extending therefrom, one or more prongs such as indicated as 16. Sheets which are output from marking device 12, such as shown as P1 in the Figure, are transported to the throat between a prong 16 and the edge of disk 14. Disk 14, after receiving a sheet, moves in the direction indicated by the arrow in the Figure, and a thus moves the sheet generally toward the position shown as P2 in the Figure. As can be seen in FIG. 1, in position P2, the sheet (and a set of accumulated sheets) will have an edge thereof proximate to a stapler head here indicated as 18, although, as will be described below, there may be provided multiple stapler heads 18.

When the stapler head 18 is activated to staple sheets in a set in position P2, the accumulated set of sheets rest on a shelf 20. Following stapling by one or Tore stapler heads 18, the staple set, in position P2, is "kicked" by a member called kicker 100, which contacts the set of sheets at various points along an edge thereof, thus pushing the set of sheets toward an output location. In the particular illustrated embodiment, the kicker 100 pushes the stapled set in position toward an output location in the form of an output tray indicated as 30. Output tray 30 may include any extra features known in the art, such as an ability to reciprocate, such as to create a offset sets of sheets, and can also index downward as the output tray 30 accumulates sets.

Figure 2:
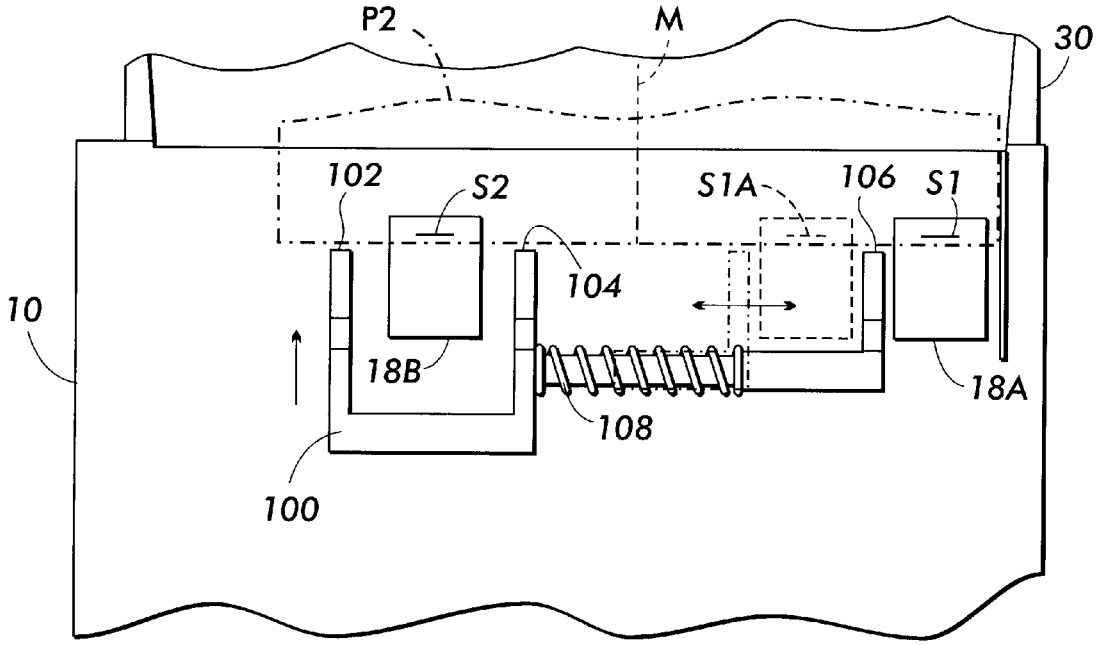
FIG. 2 a is a sectional view through the line marked 2—2 in FIG. 1.

FIG. 2 is a sectional plan view, through the line marked 2—2 in FIG. 1. The Figure shows the relationship of kicker 100 along with the multiple stapler heads, here shown as 18*a* and 18*b*, and in particular, shows a unique feature of the preferred embodiment of the member forming kicker 100. In the Figure, the sheet shown in position P2 has the relevant edge thereof disposed under two stapler heads. As can be seen, there is provided in this particular embodiment one stapler head indicated as 18A, and another stapler head indicated as 18B. If it is desired to place a single corner staple in the set of sheets in position P2, the stapler head 18*a* will place the staple in position S1 before the set is ejected, by kicker 100, toward output tray 30. If, alternately, it is desired to place two staples along the edge of the set of sheets in position P2, stapler head 18*b* will place a staple in position S2 as shown, while a stapler head 18*a* will place a staple in position S1A, as shown in the Figure. It will be noticed of that the location of the staple in position S1A is different from the position of staple S1, which would be the location of the staple when a single corner staple is used. (It should be noted that, in any particular embodiment of the invention, the stapler "heads" as shown can be either staplers themselves, or anvils into which staplers within shelf 20 drive the staples, depending on whether the staplers drive the staples upward or downward through the set of sheets.)

According to this particular embodiment of the present invention, it is desirable, when placing two staples along the edge of a set of sheets, to have the two staples roughly symmetrical with regard to a midline, such as shown as M, of the set of sheets: to place the staples in position S1 and S2 would result in a less desirable, asymmetrical placement of staples. Therefore, according to the preferred embodiment of the present invention, it is desirable to move the stapler head 18A to a position, such as shown in phantom in the Figure, where it can place the staple in position S1A.

Whether it is decided to place a single corner staple, or two symmetrically-arranged staples, in the edge of the set of sheets, following the stapling operation, the stapled set must be moved or "kicked" from shelf 20, which is the location in which the set is stapled, toward an output location such as output tray 30 shown in FIG. 1. The member which pushes the stapled set off the shelf 20 toward output tray 30 is generally indicated as kicker 100. It will be seen that the illustrated embodiment of kicker 100 has three main contact points with the set of sheets in position P2: these contact points are shown as 102, 104, and 106. Further, it will be seen as a that the member defining contact point 106 is attached to the portion of kicker 100 defining contact points 102 and 104, by deformable means, in particular a coil spring indicated as 108. Although a coiled spring is shown in the illustrated embodiment, other deformable means, such as a sponge, can be imagined. In terms of the claims below, what is most important is that the contact point 106 be movable relative to another contact point, such as 104, yet having the entire kicker 100 moveable to push the stapled set from position P2 toward an output location.

In the illustrated embodiment, the movable stapler head 18A is moved between positions corresponding to S1 and S1A by any means available in the art, such as a stepper motor or a brushless motor. Similarly, the kicker 100 is caused to push the stapled set toward the output location by means of a stepper motor or brushless motor as well. When stapler head 18A is caused to move from position S1 to position S1A, the motion of the stapler head 18A to the left in the Figure will cause the member defining contact point 106 to be pushed to the left, to assume the position shown in phantom in the Figure and thus compressing spring 108. Later, if it is desired to staple a subsequent set with a single corner staple in position S1, the stapler head 18A is caused to move, again by the stepper motor, brushless motor, or equivalent thereof, back to its position on the right as shown in the Figure: in such a case, the coil spring 108 will cause the member defining contact point 106 to reassume the non-phantom position shown in FIG. 2. In effect, when stapler head 18A is moved to the left, the stapler head 18A squeezes the member defining contact point 106 against the rest of kicker 100, and when the stapler head 18*a* is moved back to the right, the member forming contact point 106 follows the stapler head by the force of spring 108, thus redistributing the contact points between the kicker and the sheets.

A close examination of the relative positions of contact points 102, 104, and 106 in FIG. 2 show the reasons why it is desirable to have the member forming contact point 106 be movable relative to another contact point, such as 104, on the main body of kicker 100. When kicker 100, through its contact points 102, 104, and 106, is pressed against the edge of the set of sheets, the three contact points are reasonably evenly spaced along the edge of the set of sheets. If a contact point 106 of the kicker 100 were not present, the pressure of contact points 102 and 104 against their corresponding locations on the sheet would cause the set of sheets to skew upward and to the right in the view of the Figure, and not land properly in output tray 30. With the extra contact point 106, the reasonably even spacing of contact points will cause a the set of sheets to be kicked straight out to the output tray, largely without skew.

The spring mechanism 108 maintains a reasonable spacing of contact points of kicker 100 against the edge of a set of sheets being ejected, and the fact that contact point 106 is movable relative to the rest of kicker 100 enables the motion of stapler head 18*a* to be accommodated. In this way, there is provided an output device having an architecture which accommodates both accurate placement of sets in an output tray, and a movable stapler head.

What is claimed is:

1. An apparatus for retaining a plurality of sheets in a position for stapling and for transferring a stapled set of sheets to an output location, comprising:

a kicker, for contacting the set of sheets at an edge thereof, the kicker defining a first contact point and a second contact point, the second contact point being movable relative to the first contact point along the edge of the set of sheets; and means for urging the kicker against the set of sheets, thereby causing the kicker to push the set of sheets toward the output location.

2. The apparatus of claim 1, further comprising a deformable means disposed between the first contact point and the second contact point.

3. The apparatus of claim 2, the deformable means including a spring.

4. The apparatus of claim 1, further comprising a first stapler head for stapling a set of sheets prior to the kicker pushing the set of sheets toward the output location; and means for moving the first stapler head along the edge of the set of sheets, to thereby cause the first stapler head to place a staple at a predetermined position in the set of sheets;

the moving of the first stapler head causing the second contact point of the kicker to move relative to the first contact point of the kicker.

5. The apparatus of claim 1, further comprising a disk stacker for introducing sheets toward the kicker.

6. The apparatus of claim 1, further comprising a marking device for outputting sheets toward the kicker.

* * * * *